United States Patent [19]

Sibley et al.

[11] 4,357,230

[45] Nov. 2, 1982

[54] EXTRACTION OF OIL USING AMIDES

[75] Inventors: Howard W. Sibley, Baldwinsville; Joseph A. Bzdula, Fulton, both of N.Y.

[73] Assignee: Carrier Corporation, Syracuse, N.Y.

[21] Appl. No.: 191,060

[22] Filed: Sep. 25, 1980

[51] Int. Cl.[3] ..... C10G 1/04

[52] U.S. Cl. ..... 208/11 LE

[58] Field of Search ..... 208/11 LE

[56] References Cited

U.S. PATENT DOCUMENTS 3,581,823 6/1971 Feuerbacher ..... 208/11 LE X
4,156,463 5/1979 Hall ..... 208/11 LE X
4,297,206 10/1981 Scheibel ..... 208/11 LE

FOREIGN PATENT DOCUMENTS 1036524 8/1978 Canada ..... 208/11 LE
1079904 6/1980 Canada ..... 208/11 LE

*Primary Examiner*—Delbert E. Gantz
*Assistant Examiner*—Helane E. Maull
*Attorney, Agent, or Firm*—Sughrue, Mion, Zinn, Macpeak & Seas

[57] ABSTRACT

This invention relates to the extraction of oil shales and tar sands using an amide to effect extraction of kerogen and bitumenous materials from the shale or sand. Extraction may be at ambient conditions, if desired.

8 Claims, 1 Drawing Figure

TYPICAL SHALE THROUGHPUT 80,000 TONS/DA = 50,000 BBLS/DA OF OIL
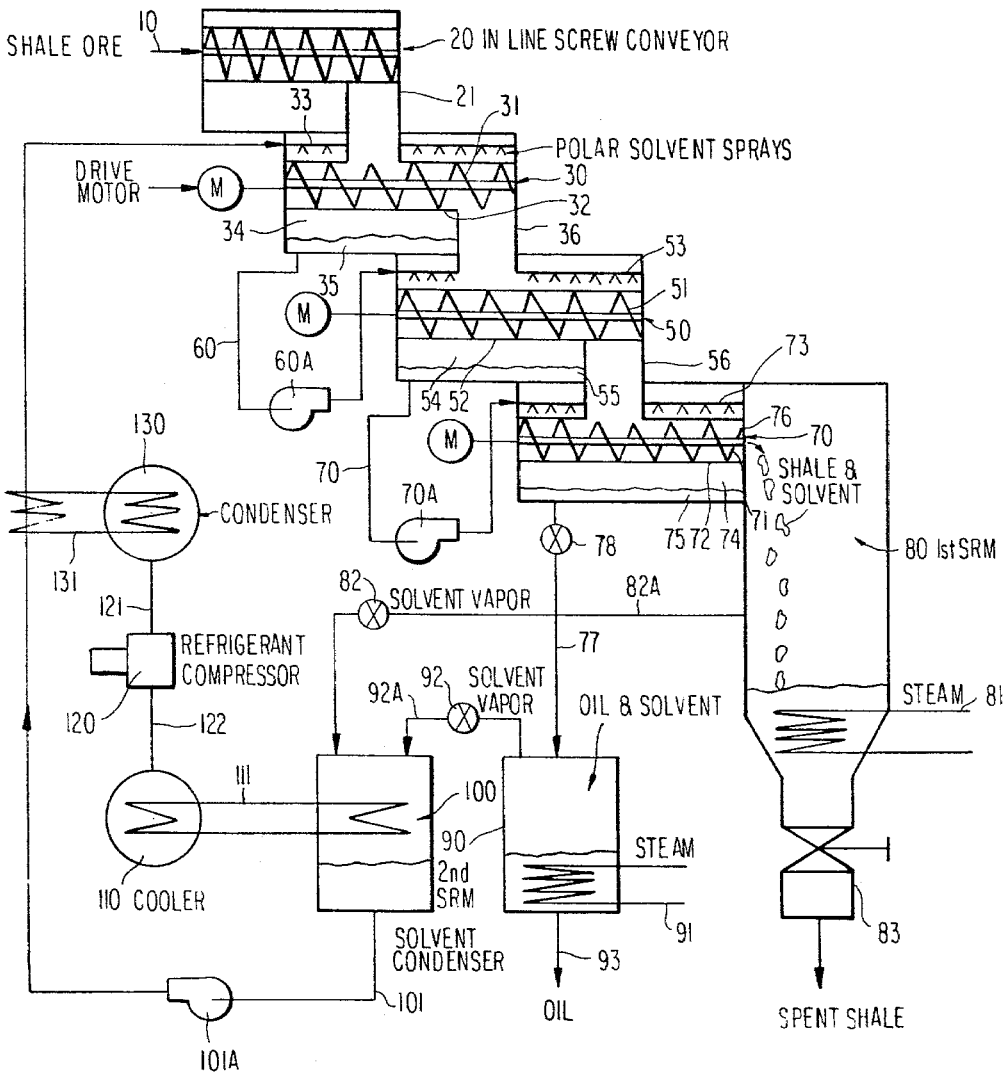

EXTRACTION OF OIL USING AMIDES

BACKGROUND OF THE INVENTION

1. Field of the Invention

The present invention relates to the extraction of oil from oil shale and tar sands.

2. Description of the Prior Art

Oil shales and tar sands represent two major sources of oil which, to date, have not fully been exploited, primarily due to the previously low cost and adequate supply of liquid crude oil and process difficulties in separating oil from oil shale and tar sand.

Nonetheless, the estimated reserves of oil existing in oil shale and tar sands throughout the world is immense and if a simple, efficient process for extracting oil from oil shale and tar sands could be developed, it would benefit the art.

Oil shales are typically fine-grained rocks resulting from the consolidation of mud, clay or silt, typically containing on the order of 20 to 50 gallons/ton of an organic, oil yielding material termed kerogen. Large oil shale deposits are found in the United States in Colorado, Utah, Wyoming and Texas. Kerogen is wax-like in nature, is characterized by low solubility in hydrocarbon solvents and typically will not flow unless heated to above 400° F.

Tar sands, on the other hand, typically comprise sand, clay and silt saturated with a heavy, viscous bitumen which will typically be on the order of 5 to 30 percent by weight of the composition. Tar sand formations are highly cohesive and have a sticky, molasses-like consistency in warm weather.

Numerous processes have been proposed by the art to extract oil from oil shale and tar sands; in general, these have typically involved retorting at high temperatures or solvent extraction procedures, usually at high temperatures.

Typical of the high temperature retorting-type procedures are those disclosed in U.S. Pat. Nos. 2,601,257 (contact with a heavy shale oil at 700°-800° F.), 2,881,126 (contact with a hot oil bath and multiple step evaporation), 3,117,072 (retorting at high temperature and pressure with a high hydrogen concentration), 3,281,349 (retorting—cat cracking—at high temperature), 4,155,832 (hydrogenation utilizing a Ziegler catalyst in an alkyl benzene or light oil fraction solvent) and 4,161,441 (retorting and cracking oil shale).

Representative of typical solvent extraction processes conducted at elevated temperatures and typically elevated pressures include those described in U.s. Pat. Nos. 2,596,793 (methylene chloride), 3,929,193 (combination of certain solvents plus S in the 0 oxidation state), 4,130,074 (incomplete extraction using a solvent vapor/solvent system—typically a halogenated hydrocarbon and water) and 4,166,022 (super heated steam).

Defensive Publication based on U.S. Ser. No. 700,489, Long et al. (861 O.G. 703), discloses the extraction of oil shales with, e.g., mono- or di-methyl amine, at super critical conditions.

Recently a number of extraction processes have been suggested which are urged to be "low temperature" extraction processes. For example, such are disclosed in U.S. Pat. Nos. 3,941,679 (halogenated hydrocarbons), 4,029,568 (aromatic aliphatic and halogenated hydrocarbons), 4,046,668 (halogenated hydrocarbons), 4,046,669 (halogenated hydrocarbons), 4,055,480 (halogenated hydrocarbons), 4,057,485 (halogenated hydrocarbons), 4,057,486 (suggesting a plurality of aliphatic, aromatic and halogenated hydrocarbons may be used, but involving a critical water concentration) and 4,160,718 (specific to tar sands, involving a water slurry and a hydrocarbon oil).

In addition to the above processes which can relatively easily be classified as "retorting" or "solvent extraction" techniques, certain hybrid processes or esoteric processes have also been described, for example, in references such as the following U.S. Pat. Nos.: 3,074,887 ($CO_2$ at high temperature and pressure), 3,346,481 (powder stream involving vaporizing components), 3,448,794 (in situ, super heating the oil shale), 4,108,760 (extractant gas, including amines), 4,156,463 (in situ, with steam and an amine), 3,497,005 (sonic energy), 4,135,579 (alternating current electric field) and 4,153,533 (microwaves).

However, all of the above processes, through such apparently offering one or more benefits to the art, are subject to one or more faults, for example:

For "retorting" type operation, high temperatures are required, necessitating high energy use, typically without good heat recovery. For a classical retorting process, quite often substantial amounts of residue result, lowering process yields.

Further, in thermal recovery systems such as in situ or surface retorting, the high temperature causes decomposition of oil and loss of recovery and undesirable fractions are generated that act as a contaminant in the recovered oil. Also with in situ retorting, charring of the oil to carbon is difficult to avoid.

For solvent extraction at high temperature, the energy input to the process is high, and thus this process is subject to the same faults as retorting processes. Further, at high temperature unless extremely efficient solvent recovery equipment is utilized, solvent losses can be high.

A fault fairly common to a large number of prior art processes, at least insofar as oil shale is concerned, is that the oil shale must be finely comminuted, which can lead to additional costs prior to active processing.

For hybrid systems, the complexity of the processing, of course, leads to substantial cost increases, an important economic disadvantage.

While many of the low temperature extraction processes seemingly overcome some of the above benefits, one substantial problem encountered is that typically the solvent utilized is either a complex mixture or a halogenated hydrocarbon, which results in relatively low yields at surprisingly high solvent costs.

A further disadvantage of many of the above prior art processes is that they are specific to processing oil shales or tar sands, and are not of universal application.

SUMMARY OF THE INVENTION

The present invention provides a process for recovering oil from oil shales or tar sands which can be practiced at low temperature with relatively simple apparatus and yet which provides high oil yields at low cost.

The process of the present invention comprises contacting oil shale with one or more amides as an extractant.

It has been found that by utilizing amide extractants, the benefits set forth above are achieved at high oil recovery rates.

BRIEF DESCRIPTION OF THE DRAWINGS

The FIGURE is a schematic representation of a continuous process for the extraction of oil shale per the present invention.

DESCRIPTION OF THE PREFERRED EMBODIMENTS

With respect to starting materials, the process of the present invention is applicable to oil shales and tar sands in general. However, since the organic content, perhaps more correctly the recoverable oil content, of such materials will vary greatly, it is generally preferred that in accordance with the present invention oil shales and tar sands of higher recoverable oil contents be utilized, most preferably having a minimum recoverable oil content of 15 gals/ton of ore as determined by the Fischer Assay Technique.

One major object of the present invention is to permit the recovery of substantially all organic components of oil shale or tar sands.

It has been discovered that oil shales and tar sands comprise, as primary organic phases, a bitumen phase which is non-polar in nature and a kerogen phase which is polar in nature. While the exact line of distinction between the polarity of the bitumen phase and the kerogen phase will overlap, it has been found that the kerogen phase is the primary source of oil recoverable from oil shales and tar sands, and that the utilization of a highly polar organic extractant or solvent, i.e., an amide, permits substantially all organic components of the oil shale or tar sand to be recovered. Surprisingly, non-polar solvents or solvents with a polarity less than that of the amides, e.g., methylene chloride, chloroform, methanol, formic acid-toluene, have proven to be ineffective as extractants as compared to the amides, albeit slightly polar and non-polar solvents will extract the bitumen phase.

While tar sands typically require no comminution treatment prior to processing per the present invention, it has been found that it is preferred in accordance with the present invention that oil shales be comminuted. While the prior art has typically required high degrees of comminution to ensure proper processing, it has been found that in accordance with the present invention relatively larger oil shale particles can be utilized, albeit an increase in extraction rate is encountered if smaller oil size particle sizes are utilized.

Oil shales of a 4 inch pass size can be processed in accordance with the present invention at reasonable processing times and at reasonable temperatures and pressures, but decreasing the size by further comminution, for example, to 100 mesh pass, will increase the extraction rate. While larger oil shale can be processed in accordance with the present invention, this does tend to increase the time required for extraction, and given the relative ease of obtaining oil shale of a 4 inch pass size, little is gained by utilizing oil shale of a larger size, though if higher retention times are acceptable, such is useful in the present invention.

The oil shale and tar sand processed in accordance with the present invention is essentially processed as received from the source area, i.e., no pre-treatments of consequence are needed other than, in certain instances, to comminute the oil shale. Thus, the present process essentially accepts virgin oil shale or tar sand as an immediate process starting material.

In accordance with the present invention, the oil shale or tar sand (for brevity, hereafter oil shale and tar sand are generally collectively referred to as oil shale, though from context it will be clear that in certain instances only one or the other is meant, e.g., in Examples 1–3) in accordance with the present invention is contacted with an amide extractant as later discussed.

Contact can be at ambient temperature and at ambient pressure; in fact, this is one major benefit of the present application since there is no need for expensive heating equipment and extensive energy consumption as required in many prior art processes.

While currently it is not believed that any benefits are obtained by active cooling or the use of sub-atmospheric pressures during processing (in fact, such would tend to increase product costs), such are not excluded from the present invention, though such are non-preferred.

In a similar fashion, for most oil shales little need will exist for processing at elevated temperatures or elevated pressures, though if extraction time becomes an overriding process parameter, elevating temperature on the order of 50° F. will reduce extraction time about one third of its original value. In certain instances, it can be seen that elevated temperature and elevated pressure operation (to prevent solvent loss) will be economically attractive, and in such cases the process of the present invention can be practiced at such elevated temperatures and pressures. It has been noted, however, that elevated temperatures and/or pressures increase the delamination of the oil shale during extraction and while delamination routinely occurs during extraction per the present invention at ambient conditions, it is to a lesser degree. Delamination of tar sand does not occur.

While in theory there is no limit to the maximum temperature utilized, as a matter of practice temperatures on the order of 400° F. maximum are utilized to avoid any possibility of amide extractant decomposition and, potentially, interactions between inorganic and/or organic components of the oil shale and the amide extractant. Typically the feed is not heated, a further savings in energy required per the process of the present invention, though if heat energy is freely available there would be no objection to heating the feed other than the need for extra process equipment.

Since it is often preferred to utilize a closed system at elevated temperatures to avoid amide extractant loss, the process of the present invention is inherently self-regulating insofar as pressure is concerned at elevated temperature, and once the temperature of operation has been set the pressure is inherently established in a closed system by the vapor pressure of the amide extractant. Since the amide and extracted oil each possess very low vapor pressures at the process temperature, this minimizes extractant loss during the solid-liquid extraction stage compared to more conventional high vapor pressure extractants such as Refrigerant 11 or methylene chloride.

A further effect noted from increasing the pressure of extraction is that this will raise the overall penetration of the amide extractant into the oil shale. While the maximum pressure utilized in not overly critical, after increasing to a pressure of about 2 atmospheres the extra cost needed for high pressure equipment begins to offset the advantages obtained, and generally gains encountered in using pressures above about 2 atmospheres do not justify the extra cost.

The time of extraction can be varied greatly, and will, of course, vary with the pressure, temperature and particles size of the oil shale undergoing processing. At 1 atmosphere and normal ambient temperature, processing oil shale of a size of about 4 inches is typically completed in about 1 hour or less. Reducing the size of the oil shale will increase the rate of extraction, but on overall balance of residence time and the extra effort to more finely comminute the oil shale, a residence time of about 1 hour has proven to provide excellent organic substance yields without excess apparatus size.

Though non-limitative typically oil shale processed per the present invention will have a particle size of from about 4" to about 6", the pressure of operation will be from about 1 to about 1.5 atmospheres, the temperature of operation will be from about 80° F. to about 350° F., and the extraction residence time (the time that the oil shale is in contact with the amide extractant) will be from about ½ to about 2 hours. As earlier indicated, tar sand size is typically "as received".

Turning now to one of the more important aspects of the present invention, the amide extractant, some background discussion is believed appropriate.

As earlier indicated, it has been discovered that a highly polar organic extractant, i.e., an organic extractant having a high dipole moment, permits extremely efficient extraction of organics from oil shale and tar sand in a simplified manner.

The non-polar bitumen and polar kerogen which are characteristic of shale ore require that an efficient extractant solvent have an unusually high molecular polarity (dipole moment) as compared to conventional solvents. The selection of amides and their derivatives as adequate solvents was based on the strong electron repelling tendency of alkane functional groups, the electron donating properties of nitrogen atoms in amides and the strong electron acceptance characteristics of the carbonyl group. Molecular polarization manifested by this combination of functional groups would be 10 to 20 fold that of standard refrigerants, chlorinated hydrocarbons, primary amines, etc.

Preferred amides for use in accordance with the present invention include those represented by the following general formula:

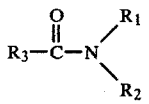

wherein $R_1$, $R_2$ and $R_3$ preferably comprise aliphatic groups having a total of 4 to 20 carbon atoms for the sum carbon atoms of $R_1$-$R_3$, more preferably 4 to 12 carbon atoms, which can be straight or branched chain, although one of $R_1$ or $R_2$ can be hydrogen, and in this situation it is preferred that the one of $R_1$ and $R_2$ which is not hydrogen be a methyl group.

Most prefered in accordance with the present invention are di-substituted acid amides having the above formula wherein $R_1$ and $R_2$ are methyl and $R_3$ comprises from 4 to 10 carbon atoms, $R_3$ being a straight or branched chain aliphatic group which is unsubstituted.

While not taken as to be limitative, examples of useful extraction solvents in accordance with the present invention are N,N-dimethylcaproamide and N,N-dimethylcaprylamide.

The process of the present invention can be practiced using a batch or continuous method. Examples thereof are later provided. In a batch method, typically the oil shale is immersed in the amide extractant. In a continuous process, typically the amide is sprayed onto the oil shale. Other methods of amide/oil shale contact can be practiced, of course, and such will be apparent to one skilled in the art.

It is important, in accordance with the present invention, that contact between the amide extractant and the oil shale be liquid-solid contact. At present, while it is suspected that gas (or vapor)—solid contact provides some degree of organic extraction from the oil shale, results to date indicate that extraction results primarily depend upon contact of liquid extractant with solid oil shale.

With respect to the amide/oil shale (or tar sand) ratio for a batch process ratios on the order of 1:1 (wt.:wt.) give excellent results, though this is not limitative. Greater amounts of amide can be used, but little is gained; in fact, as one skilled in the art will appreciate, there is no theoretical limit on the maximum amount of amide, only one of economics.

The minimum amount of amide is, of course, that which permits substantially complete extraction of the organics. While not limitative, it is preferred to use a minimum amide: oil shale (or tar sand) ratio on the order of about 1:2 (wt.:wt).

It has also been found that continuous flow processing requires lower solvent to ore or sand ratio, such as 1:4. This phenomenon is attributed to the fact that the extracted organic material from the shale itself becomes a solvent to the bitumen and kerogen. This plus the flushing of extracted organic from the surface of the material being processed by the process flow enhances fluid movement into and out of such, especially for an ore.

It has also been found that continuous flow processing requires lower solvent to ore ratio, such as 1:4. This phenomenon is attributed to the fact that the extracted organic material from the shale itself becomes a solvent to the bitumen and kerogen. This plus the flushing of extracted organic from the ore surface by the process flow enhances fluid movement into and out of the ore.

One benefit of the present invention is that the extracted organics show lower viscosity, i.e., are pumpable, if a slight amount of the amide extractant, e.g., on the order of 0.5 wt. % of the extracted organics, is permitted to remain in the extracted organics. This is often important since otherwise heating to, e.g., 400° F., would be required to render the extracted organics pumpable, a substantial energy cost. Such residual solvent can be removed in a later refining step, if desired, in a conventional fashion.

Following processing per the present invention, the extracted organics can be subjected to various conventional treatments as are known in the art to obtain various products, e.g., processed by conventional vis-cracking and catalytic hydrotreating to obtain improved saturation, naphtha, light gas oil and asphaltic fractions.

Having thus described the invention in general, the following working examples are offered to describe preferred forms of practicing the invention.

EXAMPLE 1

This Example illustrates a batch process within the present invention.

Oil shale from Mahogony Ledge, Peance Creek Basin, Rifle, Colo., was obtained in an as mined condition and comminuted into chunks of about 1 inch. The oil shale was subjected to no other treatment.

After comminution, approximately 200 grams of the comminuted oil shale was placed in a Soxhlet refluxing apparatus and than a 1 liter charge of N,N-dimethylcaproamide (viscosity: about 2 cp) was added to the Soxhlet refluxing apparatus.

The temperature in the Soxhlet apparatus was then raised to 350° F. and the system refluxed at 1 atm for 30 minutes. The resulting solution has a viscosity after refluxing of 4–5 cp. After the organics were extracted from shale by refluxing with the amide, the solution was distilled and the amide evaporated. The resulting oil contains 50% light and middle distillates, 30% wax, and 20% asphalt.

The total yield of organics from the oil shale was about 8 weight percent, based on total shale weight, which represents about 69 weight percent of all organics present in the shale.

EXAMPLE 2

Example 2 also illustrates a batch process in accordance with the present invention.

The procedure of Example 1 was followed except that a steel reflux column (6" inner diameter; 20" in height) equivalent to the Soxhlet apparatus of Example 1 in functioning was used. Further, the oil shale chunk size was about 4 inches and about 2 pounds of shale and about 2 liters of N,N-dimethylcaproamide was utilized. Otherwise, the procedure of Example 1 was followed.

Following extraction as per Example 1, results approximating theose of Example 1 were obtained except that the yield of organics was about 10 weight percent based on the oil shale weight, with about 83 percent of the total organics in the oil shale being recovered.

EXAMPLE 3

Example 3 illustrates a continuous process in accordance with the present invention, and is explained with reference to the attached FIGURE. The following explanation is offered after the system reaches steady state.

Comminuted shale ore is introduced via line 10 into a conventional in-line screw conveyor 20 provided with a conventional drive motor (not shown). In-line screw conveyor 20 is not mandatory, and shale ore can be directly introduced into later discussed first extraction zone 30, if desired.

The shale ore enters first extraction zone 30 via fall pipe 21. First extraction 30 is shown as comprising an in-line screw conveyor 31 (provided with a conventional drive motor M, as are conveyors 51 and 71) which is provided over perforate shale ore support means 32, extraction solvent spray means 33, e.g., a perforated pipe, and extraction solvent holding zone 34 containing extraction solvent/extracted organic mixture 35.

Fresh extraction solvent is introduced into extract solvent spray means 33 via line 101, the source of extraction solvent later being explained in detail.

In-line screw conveyor 31 is adapted to receive shale ore via fall pipe 21 and convey the same under extraction solvent spray means 33 whereby extraction solvent is intimately contacted with the shale ore, thereby extracting organics from the shale ore and passing through perforate shale ore support means 32 into extraction solvent hold zone 34.

The extraction solvent/extracted organic mixture 35 is relatively poor in organics from the shale ore but contains relatively active solvent, i.e., extraction solvent which is capable of further use in the process.

After shale ore is conveyed through first extraction zone 30, it exits via fall pipe 36 into second extraction zone 50.

Second extraction zone 50 is shown as comprising in-line screw conveyor 51, perforate shale ore support means 52, extraction solvent spray means 53, extraction solvent hold zone 54 and extraction solvent/extracted organic mixture 55.

The extraction solvent used in second extraction zone 50 comprises the mixture of extraction solvent/extracted organic mixture 35 taken from extraction solvent hold zone 34 via line 60 by pumping means 60A and introduced into extraction solvent spray means 53.

Processing in the second extraction zone 50 is otherwise identical to processing in the first extraction zone 30.

Shale ore which has been extracted in the second extraction 50 exits via fall pipe 56 into third extraction zone 70, shown provided with in-line screw conveyor 71, perforate shale ore support means 72, extraction solvent spray means 73, extraction solvent hold zone 74 and extraction solvent/extracted organic mixture 75.

Also shown is line 70 which receives extraction solvent/extracted organic mixture 55 from the extraction solvent hold zone 54 and introduces the same into extraction solvent spray means 73. Pumping means 70A is shown provided in line 70.

Processing in third extraction zone 70 is essentially the same as in the first and second extraction zones 30 and 50.

It is to be specifically noted that the extraction solvent/extracted organic mixture, as it advances from the first to the third extraction zones becomes increasingly loaded with organics extracted from the ore shale and this maintains the solution extraction properties because, as previously mentioned, solubilized bitumen and kerogen become solvents themselves. This tends to compensate for the depletion of organic matter from the ore as it progresses through the system.

Extraction zones 30, 50 and 70 are closed to the atmosphere by conventional means, for reasons which will now become apparent.

Extracted shale oil exits third extraction zone 70 via sealable exit port 76 into first solvent recovery means 80, the shale which is impregnated with solvent collecting at the bottom thereof where the same is heated via steam line 81. For continuous operation, shale impregnated with solvent is typically retained in a holding zone when solvent recovery is being conducted, as explained below. Where semi-continuous operation is contemplated, first solvent recovery means 80 is merely permitted to fill with shale impregnated with solvent, whereafter the same is sealed and heated.

"Product" extraction which is loaded with organic extracted from the shale is periodically removed from third extraction zone 70 via line 77 shown provided with valve 78, withdrawal typically being by pumping means (not shown) and introduced into second solvent recovery means 90 shown provided with steam line 91 and is permitted to collect at the bottom thereof.

When solvent recovery is desired, essentially first and second solvent recovery means 80 and 90 are isolated, i.e., closed from the balance of the extraction process, steam supplied to lines 81 and 91 and shale ore impregnated with solvent heated in first solvent recovery means and solvent plus organics heated in second oil recovery means 90. The heating in first solvent recovery means 80 results in boiling off solvent impregnated in the shale therein; in a similar fashion, the heating in second solvent recovery means 90 results in relatively low boiling point solvent boiling off from relatively high boiling point organics therein.

After an appropriate heating time to drive off the solvent, valves 82 and 92 are opened, permitting first solvent recovery means 80 and second solvent recovery means 90 to communicate with solvent condenser 100 via lines 82A and 92A, respectively.

Solvent condenser 100 is cooled by cooler 110 via cooling line 111 in a conventional fashion. The temperature therein is maintained at a level such that solvent flashing over from first solvent recovery means 80 and second solvent recovery means 90 will condense therein, equilibrium between the units in communication being substantially instantaneous and solvent recovery being highly effective. In more detail, solvent condenser 100 is maintained at a 40° F. condensing temperature via refrigeration cooler 110 which provides a low boiling pressure-temperature for the amide-/oil solution to facilitate evaporation of the amide from the solution and its recovery in the process condenser.

Once the desired degree of solvent condensation in solvent condenser 100 is achieved, valves 82 and 92 are closed, spent shale is removed from first solvent recovery means 80 via hopper 83 and product organics (oil) are removed from second solvent recovery means 90 via line 93. Thereafter the first solvent recovery means 80 and the second solvent recovery means 90 are returned to their original valved position to receive additional shale impregnated with solvent and solvent/organics, respectively.

Following the above, condensed solvent at a relatively cool temperature as compared to the solvent temperature in first and second solvent recovery means 80 and 90 during heating is removed from the solvent condenser via line 101 by pumping means 101A and returned to extraction solvent spray means 33 for re-use in the process of the present invention.

However, since solvent exiting solvent condenser 100 is at a relatively cool temperature, i.e., cooler than is preferred for use in the process of the present invention, it is preferred, for process kinetics and economic reasons, to heat said solvent. This is accomplished by refrigerant compressor 120 and condenser 130 via heating line 131, refrigerant compressor 120 being schematically shown as in heat exchange relationship with condensor 130 via line 121 and in heat exchange relationship with cooler 110 via line 122. Compressor 120, condenser 130 and cooler 110 enteract to produce the low temperature needed in extractant condenser 100. The heat removed by the cooler refrigerant and heat of compression of the refrigerant are rejected in condenser 130. Since the recovered amide is at a low temperature after distillation and recognizing process kinetics and economic reasons for heating the amide, the heat in condenser 130 is exchanged to the amide.

For a continuous process as above described, typical processing conditions would be:

| | |
|---|---|
| Shale ore throughput: | 80,000 tons/day |
| Organics yield: | 50,000 bbl/day |

-continued

| | |
|---|---|
| Amide spray rate in extraction zone (exclusive of 1st extracted 2nd organics) 3rd | 3,500,000 #/hr. 3,360,000 #/hr. 3,220,000 #/hr. |
| wt. % of extracted organics in amide from extraction zones: | |
| 1st | 5 |
| 2nd | 8 |
| 3rd | 10 |
| Pressure of Extraction | 1 ~ 1.5 atm. |
| Temperature of Extraction | 100 ~ 350° F. |
| Residence time in each Extraction zone | 20 minutes |
| Cooler/Refrigerant Compressor/ Condenser Operating Conditions/ Capacity: | 117,000 tons |
| Cooler | 42° F. |
| Condenser | 105° F. |
| Wt. Percent Organics Extracted from Shale Ore | |
| Based on Shale Ore Wt.: | 10% |
| Based on Total Organics: | 69% |
| Steam Line Conditions: | 12 psig (250° F.) |

While the invention has been described in detail and with reference to specific embodiments thereof, it will be apparent to one skilled in the art that various changes and modifications can be made therein without departing from the spirit and scope thereof.

What is claimed is:

1. In a process for extracting organic materials from oil shale or tar sand by contacting the same with an organic extractant, the improvement wherein said organic extractant is an aliphatic amide comprisng the moiety

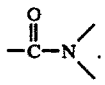

2. The process of claim 1 wherein said amide is represented by the formula:

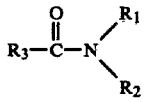

where $R_1$, $R_2$ and $R_3$ comprise in total 4 to 20 carbon atoms.

3. The process of claim 2 wherein at least two of $R_1$, $R_2$ and $R_3$ are aliphatic groups, with the proviso that $R_3$ is an aliphatic group but one of $R_1$ or $R_2$ can be hydrogen.

4. The process of claim 3 wherein $R_1$ and $R_2$ are methyl and $R_3$ is an aliphatic group of 4 to 10 carbon atoms.

5. The process of claim 2 wherein extraction is at a temperature of about 80° to about 350° F., a pressure of from about 1 to about 1.5 atmospheres and for a period of from about 30 minutes to about 2 hours.

6. The process of claim 5 wherein said oil shale is extracted.

7. The process of claim 5 wherein said tar sand is extracted.

8. The process of claim 6 wherein said amide is removed from said oil shale subsequent to said extraction.

* * * * *